US009410551B2

(12) United States Patent
Winkes

(10) Patent No.: US 9,410,551 B2
(45) Date of Patent: Aug. 9, 2016

(54) METHOD FOR OPERATING A COMPRESSOR

(75) Inventor: Georg Winkes, Kaarst (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 807 days.

(21) Appl. No.: 13/812,952

(22) PCT Filed: Jul. 18, 2011

(86) PCT No.: PCT/EP2011/062248

§ 371 (c)(1), (2), (4) Date: Jan. 29, 2013

(87) PCT Pub. No.: WO2012/013530

PCT Pub. Date: Feb. 2, 2012

(65) Prior Publication Data

US 2013/0129477 A1 May 23, 2013

(30) Foreign Application Priority Data

Jul. 29, 2010 (DE) ..... 10 2010 032 652

(51) Int. Cl.
*F04D 27/00* (2006.01)
*F04D 27/02* (2006.01)

(52) U.S. Cl.
CPC ..... *F04D 27/00* (2013.01); *F04D 27/0207* (2013.01); *F04D 27/0246* (2013.01); *F04D 27/0284* (2013.01)

(58) Field of Classification Search
CPC . F04D 27/02; F04D 27/0246; F04D 27/0284; F04D 27/0207; F04D 27/0223; F04D 27/0292; F05D 2270/46; F05D 2270/101
See application file for complete search history.

(56) References Cited

U.S. PATENT DOCUMENTS

2009/0274565 A1* 11/2009 White ..... F04D 27/0215 417/282
2010/0152918 A1* 6/2010 Riverin ..... F04D 27/02 700/301

FOREIGN PATENT DOCUMENTS

| | | | |
|---|---|---|---|
| CN | 1671967 | A | 9/2005 |
| CN | 1330229 | C | 8/2007 |
| DE | 69728254 | T2 | 3/2005 |
| DE | 112004000695 | T5 | 10/2006 |
| DE | 102007035927 | A1 | 2/2009 |

(Continued)

*Primary Examiner* — Richard Edgar
*Assistant Examiner* — Brian P Wolcott

(57) ABSTRACT

A method for operating a compressor including providing suction pressure measurement, final pressure measurement, throughput measurement is provided. Using a first control characteristic map a target value for a pump surge limiter is determined from one or two of the measurements, and the pump surge limiter compares the target value to the throughput measurement, wherein the pump surge limiter opens a bypass valve when the measured value falls below or exceeds the target value, such that the final pressure is lowered or the flow through the compressor is increased. In the event of failure of a measurement, a further measurement of another physical variable of the compression process, together with a measured variable that did not fail or a modification of the measured variable, is an input variable for a substitute control characteristic map, form which a substitute target value is determined.

5 Claims, 3 Drawing Sheets

(56) References Cited

FOREIGN PATENT DOCUMENTS

| | | | |
|---|---|---|---|
| DE | 102008058799 | A1 | 6/2010 |
| EP | 0336092 | A2 | 10/1989 |
| EP | 0676545 | A2 | 10/1995 |
| EP | 1635066 | A2 | 3/2006 |
| JP | 2000505525 | A | 5/2000 |
| JP | 4345672 | B2 | 10/2009 |
| WO | WO 2010040734 | A1 | 4/2010 |

* cited by examiner

METHOD FOR OPERATING A COMPRESSOR

CROSS REFERENCE TO RELATED APPLICATIONS

This application is the US National Stage of International Application No. PCT/EP2011/062248, filed Jul. 18, 2011 and claims the benefit thereof. The International Application claims the benefits of German application No. 10 2010 032 652.6 DE filed Jul. 29, 2010. All of the applications are incorporated by reference herein in their entirety.

FIELD OF INVENTION

The invention relates to a method for operating a compressor, comprising the installed measurements of: a) suction pressure measurement, b) final pressure measurement, c) throughput measurement, wherein, in normal operation, during which the measurements proceed faultlessly, a target value for a surge limiter is determined from one or two of the measured variables by means of a first control characteristic map and the surge limiter compares this target value with the third measured variable directly or indirectly, wherein the surge limiter opens a bypass valve if the third measured value falls below or exceeds the target value or there is a modification of the third measured value in comparison with the target value, with the result that the final pressure is lowered.

BACKGROUND OF INVENTION

In the operation of a compressor, it must be ensured that the ratio of the final pressure to an intake pressure is not so high that the throughput through the compressor falls below a certain minimum amount. This lower limit is defined essentially by greatly increasing vibrations of the machine, which are caused inter alia by so-called surges. Those skilled in the art refer to the limit between regular operation and this so-called surging as the surge limit. This surge limit depends essentially on the ratio between the intake pressure and the final pressure. For the surge limitation of turbo compressors, algorithms that continually determine the margin from the surge limit on the basis of multiple measured values are used. If this margin becomes too small, the limiter opens a bypass valve, and thus ensures a minimum margin from the surge limit, at which the final pressure is lowered and accordingly the required throughput, mass flow or volume flow is restored. During normal operation unaffected by any fault, the so-called surge limitation for controlling the bypass valve protects the compressor from damage that would be caused by surging, it being necessary to ensure that the protection of the machine from this damage is still provided if there is a failure of one of the measuring signals involved.

One possibility of responding to a signal failure at the measuring points is to substitute the fault-affected measured value by the worst conceivable measured value—that is to say a value that gives a greater proximity to the surge limit then is the case in reality. The machine is consequently still protected from surges, but it may be that the bypass valve, which is usually formed as a control valve, is opened unnecessarily, with the result that the efficiency of the installation deteriorates. At worst, the valve opens so far that the throughput through the compressor is reduced to an unacceptable minimum, and so the connected process, which is generally strongly dependent on the compression process, can no longer be maintained.

Apart from the possibility described above, it is also known for the surge limiter to generate in the case of a fault a constant output signal that opens the valve to such an extent that under some circumstances surging may occur. This too leads to an adverse influence on the connected process.

The measured values that are measured generally also comprise a measurement of the throughput through the compressor. In this connection, it is also known in the event of a fault that does not concern the measurement of the throughput to adjust the compressor to the throughput of a minimum value at which surging is ruled out.

A further known possibility of countering a fault in the measurements is to specify that the pressure ratio is assumed to be constant and to correspond to the greatest possible pressure ratio to be expected, which likewise gives a great margin from the surge limit. A failure of the suction pressure measurement cannot be managed in this way.

SUMMARY OF INVENTION

On the basis of the problems of the prior art, the invention has set itself the object of developing a fallback strategy in the event of failure of one of the aforementioned measurements for the operation of a compressor of the type mentioned at the beginning that ensures an acceptable level of efficiency in continued operation in spite of a maximum degree of reliability.

To achieve the object according to the invention, a method of the type mentioned at the beginning with the features of the claims is proposed.

The measured values of a suction pressure measurement or final pressure measurement are understood by the invention as meaning both the measured parameters in a unit that is characteristic of the physical parameter and a modification of this measured value by a normalizing process, in particular a normalizing process that makes this measured value dimensionless. This is expedient for example in the case of the suction pressure and the final pressure if they are normalized to the suction pressure. The throughput is regularly measured by means of a differential pressure measurement by way of an orifice plate and can accordingly also be specified in the physical unit of a pressure, and accordingly in the same way can particularly expediently be modified in a dimensionless form, like the suction pressure and the final pressure. In principle, however, a different kind of quantitative measurement is also possible, and implementation of the invention with measured variables that are not normalized or are given in dimensional units. The corresponding difference from the method previously known in the prior art is that, with regard to the failed measured variable, it is not simply that an essentially constant value is assumed, but instead that an already existing, different measured variable is used, in order to convert it with the still remaining intact measured variables in a substitute control algorithm or substitute control characteristic map into a target value for the surge limiter. This difference leads to a much better use of the possible operating range, with at the same time improved efficiency as compared with conventional methods for operating compressors in the event of failure of one of the measuring points that have an influence on the surge limitation.

A preferred embodiment of the invention provides that, in normal operation, a target value for the surge limiter that corresponds to a minimum value for the throughput is determined from the suction pressure measurement and the final pressure measurement by means of the first control characteristic map. as According to the invention said further measurement of the other physical variable of the compression process are is the measurement of the setting angle of an intake guiding apparatus. The variation of the setting angle of the intake guiding apparatus or of the rotational speed is suitable in particular for the substitute control in the event of failed measurement of the final pressure or the intake pressure. A specific position of the intake guiding apparatus can in this case be respectively assigned a maximum ratio of final pressure to intake pressure. The same applies analogously to the rotational speed. In this way, a particularly good approximation to the surge limiting line is obtained in each case for the substitute control. It is expedient for the relationship between the maximum ratio between the final pressure and the intake pressure and the setting angle of the intake guiding apparatus or the rotational speed to be implemented by means of a supplementary characteristic map, which is used in the case of a fault of the measurement of the final pressure or the intake pressure by the surge limiter for converting the variables into one another. If the measurement of the final pressure has failed, a good approximation for the pressure ratio, from which the quantitative target value is formed, is obtained from:

$$\frac{p_E}{p_A} \leq \frac{p_E}{p_A}\Big|_{max} = f(\alpha).$$

The supplementary characteristic map may also be used if there is a failure of the suction pressure measurement. The minimum quantitative target value is then formed according to the above approximation for the maximum pressure ratio. The formula for the calculation of the actual values often includes the suction pressure, for example in the form $$\dot{V} \approx \sqrt{\frac{\Delta p}{PaA}}.$$

An estimate without using the suction pressure can be given for example by the following formula:

$$\frac{\Delta p}{p_A} \leq \frac{\Delta p}{p_E} * \frac{p_E}{p_A}\Big|_{min}$$

If the measurement of the throughput, in particular the measurement of the differential pressure by way of an orifice plate, fails, it is expedient in a development of the invention if the following equation is implemented by the surge limiter:

$$\frac{P_E}{p_A} \leq S * \frac{P_E}{P_A}\Big|_{min=f(\alpha)\ or\ f(n), where\ S<1\ (safety\ coefficient)}$$

BRIEF DESCRIPTION OF THE DRAWINGS

For better understanding, the invention is described here on the basis of a specific exemplary embodiment with reference to drawings, while a person skilled in the art can obtain further possible ways in which the invention can be embodied particularly by any desired combination of the patent claims. In the drawing:

DETAILED DESCRIPTION OF INVENTION

Figure 1:
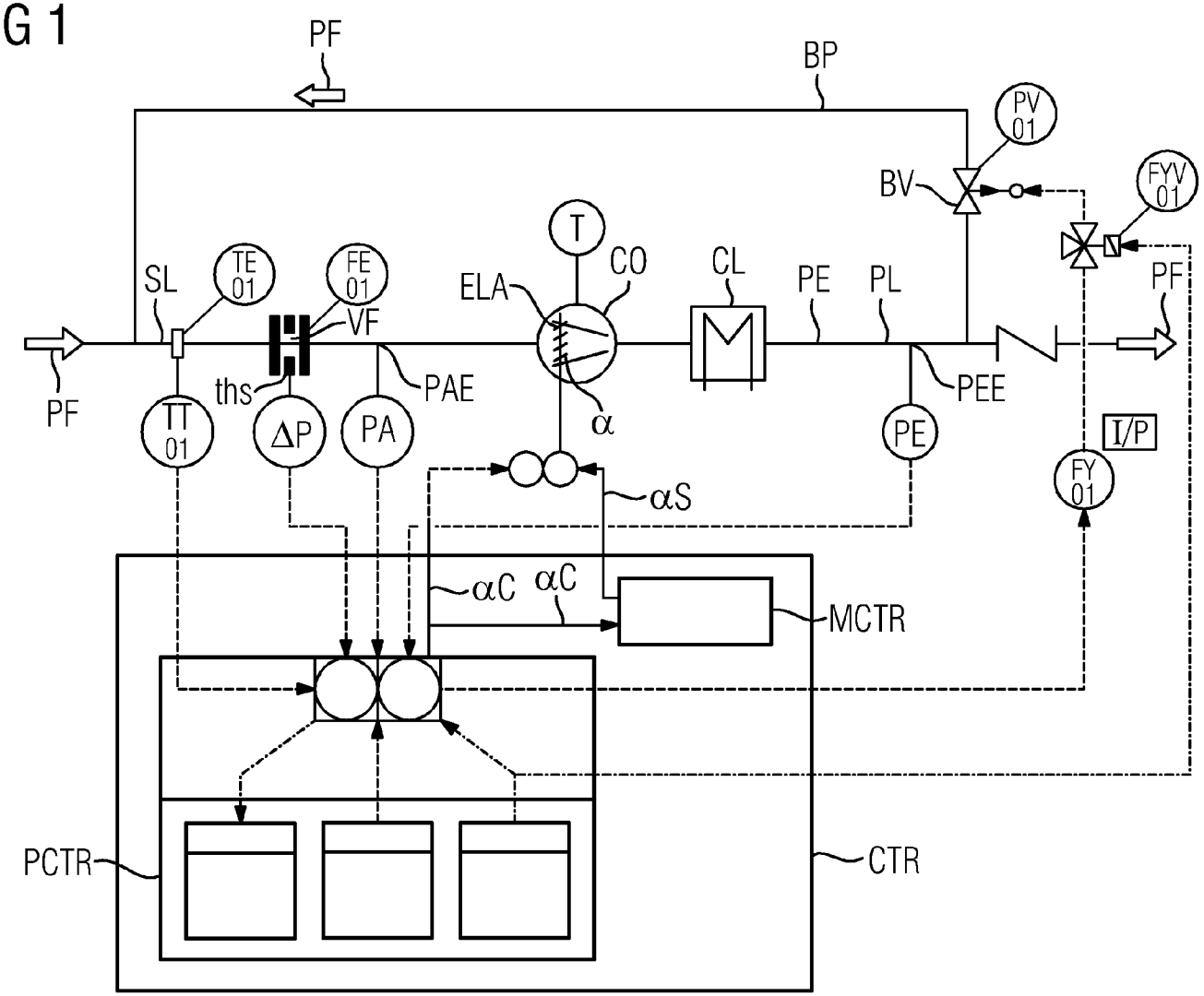
FIG. 1 shows a schematic representation of the individual components of a compressor, as it is controlled by means of the method according to the invention.

FIG. 1 shows a compressor CO with the associated auxiliary systems and a drive T, which is formed here in the manner of a hot gas expander. The compressor CO receives process fluid PF on a suction line SL at an intake pressure PA and compresses it to a final pressure PE while it is being transported to a pressure line PL. After the compressor CO, the compressed process fluid PF is cooled in a heat exchanger CL. On the input side on the suction line SL of the compressor CO, an intake temperature TE is measured by means of a temperature measuring point TT, a volume flow VF is measured by means of a volume measuring point FE, by way of a pressure difference ΔP of an orifice plate there, and the intake pressure PA is measured by means of a simple pressure measuring point PAE. Directly before the intake into the rotor of the compressor CO there is also an intake guiding apparatus ELA, which is set to the setting angle α. Expediently, either the drive T is of a speed-variable form or an intake guiding apparatus ELA is provided. A quantity controller MCTR controls the setting angle α of the intake guiding apparatus ELA by specifying a target value αS for the setting angle α. The actual value αC for the setting angle α is transmitted to the quantity controller MCTR by a position transducer ZT.

On the pressure line, the final pressure PE is measured behind the heat exchanger CL by means of a pressure measuring point PEE. The results of all the measurements are recorded by a control system CTR, part of this control system being a surge limitation PCTR. Decisive for the surge limitation is the activation of a bypass valve BV, which is formed as a control valve and controls the opening of a bypass BP, which short-circuits the pressure line PL with the suction line SL by way of a defined opening when the compressor CO threatens to reach the state of surging.

Figure 2:
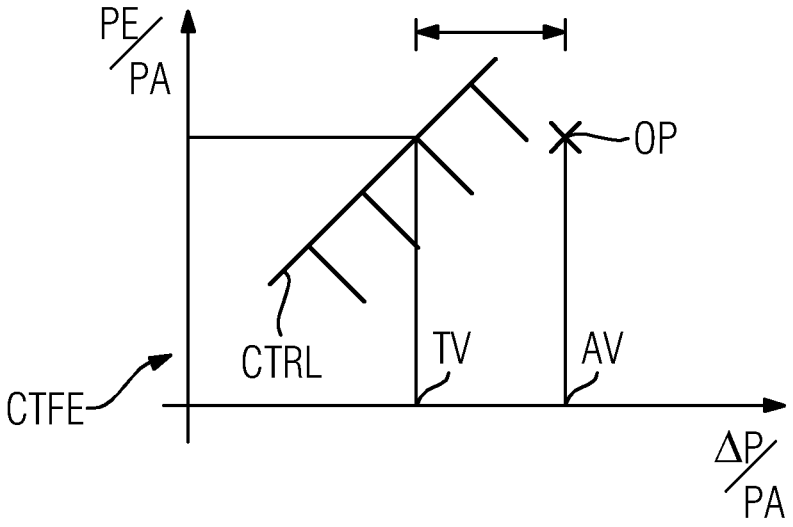
FIG. 2 shows the representation of a control line from the polyline in the control characteristic map for a surge limiter in normal operation.

FIG. 2 shows an operating point OP and a control line CTRL as an extract from the control characteristic map CTFE, which is not represented completely here. The Y coordinate of the diagram represented gives the ratio of the final pressure PE to the intake pressure PA and the X coordinate gives the ratio of the differential pressure ΔP at the throughput measurement to the intake pressure PA. The measured ratio of the final pressure PE to the intake pressure PA is the basis for the determination of the target value TV of the surge limiter PCTR. The actual value AV at the operating point OP is formed by way of the ratio of the differential pressure ΔP in relation to the intake pressure PA. The diagram shown essentially illustrates a relationship of the compression performance on the Y coordinate and the throughput through the compressor CO on the X coordinate. The surge limitation PCTR opens the bypass valve BV if the operating point OP reaches the target value TV or the surge limiting line CTRL with regard to the throughput.

The precision of the control can be additionally improved if, instead of $$\frac{\Delta p}{p_A},$$

the X coordinate of the control characteristic map CTFE additionally takes into consideration the temperature influence at the compressor intake, with $$\frac{\Delta p * TE}{p_A}.$$

The control does not envisage that the intake pressure PA is constant.

Figure 3:
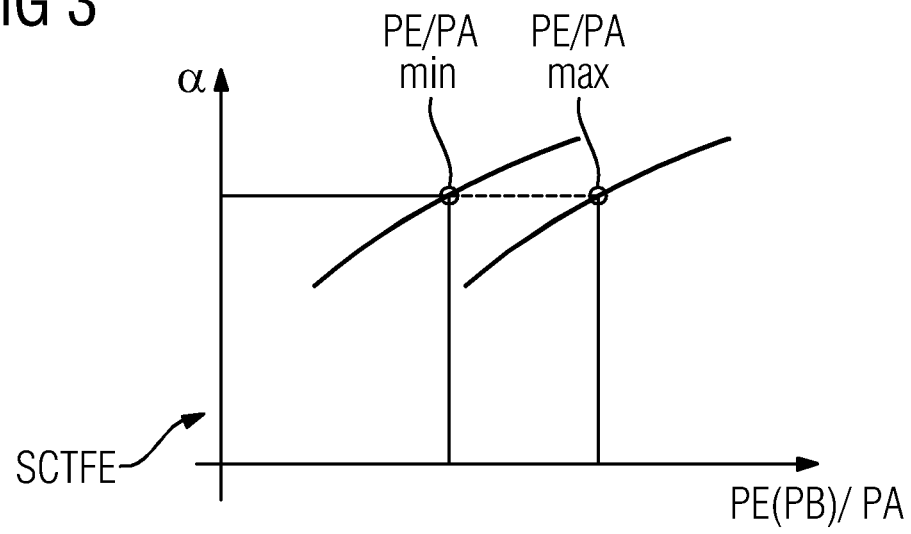
FIG. 3 shows the representation of an additional characteristic map for the surge limiter.

FIG. 3 shows a relationship between the setting angle α as an input variable and minimum and maximum ratios between final pressures PE and intake pressures PA, represented in a substitute control characteristic map SCTFE, which is implemented by the surge limitation PCTR if there is a failure in the measurement of the intake pressure or the final pressure or the quantity. On the basis of the measurement of the setting angle α, these minimum and maximum pressure ratios between the input and the output can be determined and implemented in the method according to the invention as provided by the sequence represented in FIG. 4.

Figure 4:
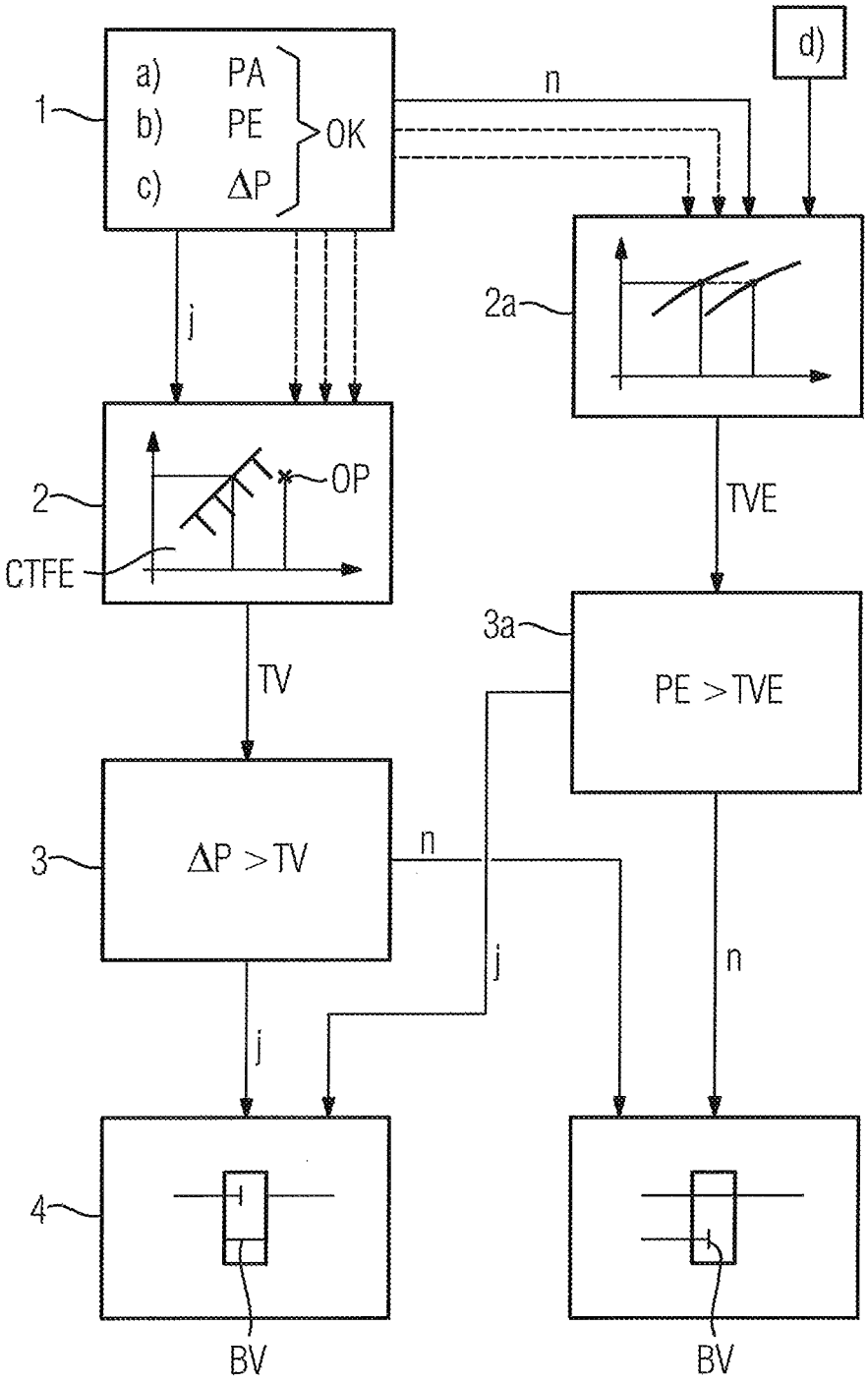
FIG. 4 shows a flow diagram of the method according to the invention.

FIG. 4 shows a flow diagram of the method according to the invention. In the flow diagram of FIG. 4, the method according to the invention is divided into four successive steps, at least three measurements being performed in a first step, here the intake pressure PA, the final pressure PE and a differential pressure measurement ΔP performed to determine the throughput. If under 1) these measurements are faultless (Y), the method moves on to step 2), during which the operating point OP is determined by means of the measurements on the basis of a control characteristic map CTFE and a target value TV is determined on the basis of the difference from the control line CTRL. In the subsequent step 3), the target value TV is compared with the pressure difference ΔP, the bypass valve BV remaining closed in the case of a greater value of ΔP as compared with TV and otherwise being opened in a fourth step. If in method step 1) there is a fault in one of the measurements, a further measurement d) is used for the evaluation in a substitute control characteristic map SCTFE to determine a substitute target value ETV. In the subsequent step 3a), a comparison is carried out in the same way, as in step 3), here between the final pressure PE and the substitute target value TVE. If the final pressure PE is greater, a closing of the bypass valve BV takes place, otherwise an opening, in method step 4).

The invention claimed is:

1. A method for operating a compressor, comprising:

providing measured values including a suction pressure measurement, a final pressure measurement, and a throughput measurement;

in normal operation during which the measured values proceed faultlessly, determining a target value for a surge limiter from a measured value by means of a first control characteristic map;

comparing the target value with the throughput measurement directly or indirectly by the surge limiter; and opening a closed bypass valve by the surge limiter when the throughput measurement falls below or exceeds the target value whereby the final pressure is lowered or a flow through the compressor is increased, wherein in the event of failure of a measured value, the determining step includes determining a substitute target value by a substitute control characteristic map using a further measurement of another physical variable of the compression process and one of the measured values that did not fail or a modification of the measured value that did not fail, wherein the further measurement is a measurement of a setting angle of an intake guiding apparatus, and wherein, in the event of a failure of the final pressure measurement or the suction pressure measurement, the following applies:

$$\frac{p_E}{p_A} \leq \left.\frac{p_E}{p_A}\right|_{max} = f(\alpha)$$

or $$\frac{p_E}{p_A} \leq \left.\frac{p_E}{p_A}\right|_{max} = f(n)$$

wherein

α=setting angle of the intake guiding apparatus, and n=rotational speed of the drive.

2. The method as claimed in claim 1, wherein, in normal operation, the target value for the surge limiter, which corresponds to a minimum value for the throughput measurement, is determined from the suction pressure measurement and the final pressure measurement by means of the first control characteristic map, whereby the surge limiter opens the bypass valve when the throughput measurement falls below a minimum value for the throughput measurement.

3. The method as claimed in claim 1, wherein the suction pressure measurement and/or the final pressure measurement and/or the throughput measurement as an input variable of a characteristic map are normalized to a process variable.

4. The method as claimed in claim 3, wherein the suction pressure measurement is the input variable of the characteristic map that is normalized to the process value.

5. The method as claimed in claim 1, wherein, in the event of a failure of the throughput measurement, the pressure ratio is limited by a limiter according to:

$$\frac{p_E}{p_A} \leq \left.\frac{p_E}{p_A}\right|_{min} * S$$

with S<1.

* * * * *